US008398466B2

(12) United States Patent
Sung et al.

(10) Patent No.: US 8,398,466 B2
(45) Date of Patent: Mar. 19, 2013

(54) CMP PAD CONDITIONERS WITH MOSAIC ABRASIVE SEGMENTS AND ASSOCIATED METHODS

(76) Inventors: Chien-Min Sung, Tansui (TW); Michael Sung, San Francisco, CA (US)

( * ) Notice: Subject to any disclaimer, the term of this patent is extended or adjusted under 35 U.S.C. 154(b) by 1139 days.

(21) Appl. No.: 12/168,110

(22) Filed: Jul. 5, 2008

(65) Prior Publication Data

US 2009/0068937 A1 Mar. 12, 2009

Related U.S. Application Data

(63) Continuation-in-part of application No. 11/560,817, filed on Nov. 16, 2006, now Pat. No. 7,762,872.

(60) Provisional application No. 60/976,198, filed on Sep. 28, 2007.

(51) Int. Cl.
*B24B 53/02* (2012.01)

(52) U.S. Cl. ..... 451/443

(58) Field of Classification Search ..... 451/443
See application file for complete search history.

(56) References Cited

U.S. PATENT DOCUMENTS

| | | | |
|---|---|---|---|
| 187,593 | A | 2/1877 | Brown et al. |
| 1,854,071 | A | 4/1932 | Schacht |
| 1,988,065 | A | 1/1935 | Wooddell |
| 2,027,087 | A | 1/1936 | Buckner |
| 2,027,307 | A | 1/1936 | Schacht |
| 2,033,991 | A | 3/1936 | Melton |
| 2,035,521 | A | 3/1936 | Benner |
| RE20,660 | E | 2/1938 | Schacht |
| 2,184,348 | A | 12/1939 | Kirchner |
| 2,187,624 | A | 1/1940 | Melton |
| 2,194,253 | A | 3/1940 | Benner |
| 2,268,663 | A | 1/1942 | Kuzmick |
| 2,281,558 | A | 5/1942 | Cross |
| 2,318,570 | A | 5/1943 | Carlton |
| 2,334,572 | A | 11/1943 | Melton |
| 2,612,348 | A | 9/1952 | Catallo |
| 2,725,693 | A | 12/1955 | Smith |
| 2,811,960 | A | 11/1957 | Fessel |
| 2,867,086 | A | 1/1959 | Haley |
| 2,876,086 | A | 3/1959 | Raymond |
| 2,947,608 | A | 8/1960 | Hall |
| 2,652,951 | A | 9/1960 | Simpson |
| 2,952,951 | A | 9/1960 | Simpson |

(Continued)

FOREIGN PATENT DOCUMENTS

| | | |
|---|---|---|
| CN | 1351922 | 6/2002 |
| CN | 1494984 | 5/2004 |

(Continued)

OTHER PUBLICATIONS

U.S. Appl. No. 12/328,338, filed Dec. 4, 2008, Chien-Min Sung, Office Action issued Jan. 3, 2011.

(Continued)

*Primary Examiner* — Maurina Rachuba
(74) *Attorney, Agent, or Firm* — Thorpe North & Western LLP

(57) ABSTRACT

A CMP pad conditioner comprises a plurality of abrasive segments. Each abrasive segment includes a segment blank and an abrasive layer attached to the segment blank, the abrasive layer including a superhard abrasive material. A pad conditioner substrate is also provided. Each of the plurality of abrasive segments is permanently affixed to the pad conditioner substrate in an orientation that enables removal of material from a CMP pad by the abrasive layer as the pad conditioner and the CMP pad are moved relative to one another.

10 Claims, 6 Drawing Sheets

U.S. PATENT DOCUMENTS

| | | | |
|---|---|---|---|
| 3,067,551 | A | 12/1962 | Maginnis |
| 3,121,981 | A | 2/1964 | Hurst |
| 3,127,715 | A | 4/1964 | Christensen |
| 3,146,560 | A | 9/1964 | Hurst |
| 3,276,852 | A | 10/1966 | Lemelson |
| 3,293,012 | A | 12/1966 | Smiley |
| 3,372,010 | A | 3/1968 | Parsons |
| 3,377,411 | A | 4/1968 | Charvat |
| 3,416,560 | A | 12/1968 | Bruno |
| 3,440,774 | A | 4/1969 | Curn |
| 3,608,134 | A | 9/1971 | Cook |
| 3,625,666 | A | 12/1971 | James |
| 3,630,699 | A | 12/1971 | Catlin |
| 3,631,638 | A | 1/1972 | Yoshikawa et al. |
| 2,078,354 | A | 4/1973 | Webster |
| 3,743,489 | A | 7/1973 | Wentorf et al. |
| 3,767,371 | A | 10/1973 | Wentorf et al. |
| 3,802,130 | A | 4/1974 | Lindenbeck |
| 3,819,814 | A | 6/1974 | Pope |
| 3,852,078 | A | 12/1974 | Wakatsuki |
| 3,894,673 | A | 7/1975 | Lowder et al. |
| 3,982,358 | A | 9/1976 | Fukuda |
| 4,018,576 | A | 4/1977 | Lowder et al. |
| 4,078,906 | A | 3/1978 | Green |
| 4,149,881 | A | 4/1979 | D'Silva |
| 4,155,721 | A | 5/1979 | Fletcher |
| 4,182,628 | A | 1/1980 | D'Silva |
| 4,188,194 | A | 2/1980 | Gorrigan |
| 4,201,601 | A | 5/1980 | D'Silva |
| 4,211,294 | A | 7/1980 | Multakh |
| 4,211,924 | A | 7/1980 | Muller et al. |
| 4,224,380 | A | 9/1980 | Bovenkerk et al. |
| 4,228,214 | A | 10/1980 | Steigelman et al. |
| 4,229,186 | A | 10/1980 | Wilson |
| 4,273,561 | A | 6/1981 | Villalobos |
| 4,287,168 | A | 9/1981 | Wentorf et al. |
| 4,289,503 | A | 9/1981 | Corrigan |
| 4,341,532 | A | 7/1982 | Oide |
| 4,355,489 | A | 10/1982 | Heyer et al. |
| 4,481,016 | A | 11/1984 | Campbell et al. |
| 4,525,179 | A | 6/1985 | Gigl |
| 4,547,257 | A | 10/1985 | Iizuka et al. |
| 4,551,195 | A | 11/1985 | Iizuka et al. |
| 4,565,034 | A | 1/1986 | Sekiya |
| 4,610,699 | A | 9/1986 | Yazu et al. |
| 4,617,181 | A | 10/1986 | Yazu et al. |
| 4,629,373 | A | 12/1986 | Hall |
| 4,632,817 | A | 12/1986 | Yazu et al. |
| 4,662,896 | A | 5/1987 | Dennis |
| 4,669,522 | A | 6/1987 | Griffin |
| 4,680,199 | A | 7/1987 | Vontell et al. |
| 4,712,552 | A | 12/1987 | Pangburn |
| 4,749,514 | A | 6/1988 | Murakami et al. |
| 4,770,907 | A | 9/1988 | Kimura |
| 4,776,861 | A | 10/1988 | Frushour |
| 4,780,274 | A | 10/1988 | Barr |
| 4,797,241 | A | 1/1989 | Peterson et al. |
| 4,828,582 | A | 5/1989 | Frushour |
| 4,849,602 | A | 7/1989 | Gardner |
| 4,866,888 | A | 9/1989 | Murai et al. |
| 4,883,500 | A | 11/1989 | Deakins et al. |
| 4,908,046 | A | 3/1990 | Wiand |
| 4,916,869 | A | 4/1990 | Oliver |
| 4,923,490 | A | 5/1990 | Johnson et al. |
| 4,925,457 | A | 5/1990 | deKok et al. |
| 4,927,619 | A | 5/1990 | Tsuji |
| 4,943,488 | A | 7/1990 | Sung et al. |
| 4,945,686 | A | 8/1990 | Wiand |
| 4,949,511 | A | 8/1990 | Endo et al. |
| 4,954,139 | A | 9/1990 | Cerutti |
| 4,968,326 | A | 11/1990 | Wiand |
| 5,000,273 | A | 3/1991 | Horton et al. |
| 5,011,513 | A | 4/1991 | Zador et al. |
| 5,022,895 | A | 6/1991 | Wiand |
| 5,024,680 | A | 6/1991 | Chen et al. |
| 5,030,276 | A | 7/1991 | Sung et al. |
| 5,037,451 | A | 8/1991 | Burnand et al. |
| 5,043,120 | A | 8/1991 | Corrigan |
| 5,049,165 | A | 9/1991 | Tselesin |
| 5,092,082 | A | 3/1992 | Padberg |
| 5,092,910 | A | 3/1992 | deKok et al. |
| 5,116,568 | A | 5/1992 | Sung |
| 5,131,924 | A | 7/1992 | Wiand |
| 5,133,782 | A | 7/1992 | Wiand |
| 5,137,543 | A | 8/1992 | Heath et al. |
| 5,151,107 | A | 9/1992 | Cho et al. |
| 5,164,247 | A | 11/1992 | Solanki et al. |
| 5,176,155 | A | 1/1993 | Rudolph, Jr. |
| 5,190,568 | A | 3/1993 | Tselesin |
| 5,194,070 | A | 3/1993 | Sumiya et al. |
| 5,194,071 | A | 3/1993 | Corrigan et al. |
| 5,195,403 | A | 3/1993 | Sani et al. |
| 5,195,404 | A | 3/1993 | Notter et al. |
| 5,197,249 | A | 3/1993 | Wiand |
| 5,203,881 | A | 4/1993 | Wiand |
| 5,232,320 | A | 8/1993 | Tank et al. |
| 5,243,790 | A | 9/1993 | Gagne |
| 5,246,884 | A | 9/1993 | Jaso |
| 5,247,765 | A | 9/1993 | Quintana |
| 5,248,317 | A | 9/1993 | Tank |
| 5,264,011 | A | 11/1993 | Brown et al. |
| 5,266,236 | A | 11/1993 | Bovenkerk |
| 5,271,547 | A | 12/1993 | Carlson |
| 5,273,730 | A | 12/1993 | Yoshida et al. |
| 5,295,402 | A | 3/1994 | Bovenkerk |
| 5,314,513 | A | 5/1994 | Miller |
| 5,328,548 | A | 7/1994 | Tsuji et al. |
| 5,364,423 | A | 11/1994 | Bigelow et al. |
| 5,374,293 | A | 12/1994 | Takashita et al. |
| 5,380,390 | A | 1/1995 | Tselesin |
| 5,443,032 | A | 8/1995 | Vichr et al. |
| 5,453,106 | A | 9/1995 | Roberts |
| 5,454,343 | A | 10/1995 | Eun et al. |
| 5,458,754 | A | 10/1995 | Sathrum et al. |
| 5,486,131 | A | 1/1996 | Cesna et al. |
| 5,492,771 | A | 2/1996 | Lowder et al. |
| 5,492,774 | A | 2/1996 | Tateno et al. |
| 5,496,386 | A | 3/1996 | Broberg et al. |
| 5,500,248 | A | 3/1996 | Iacovangelo et al. |
| 5,505,272 | A | 4/1996 | Clark |
| 5,518,443 | A | 5/1996 | Fisher |
| 5,527,424 | A | 6/1996 | Mullins |
| 5,536,202 | A | 7/1996 | Appel et al. |
| 5,547,417 | A | 8/1996 | Breivogel et al. |
| 5,551,959 | A | 9/1996 | Martin et al. |
| 5,560,745 | A | 10/1996 | Roberts |
| 5,560,754 | A | 10/1996 | Johnson et al. |
| 5,609,286 | A | 3/1997 | Anthon |
| 5,620,489 | A | 4/1997 | Tselesin |
| 5,660,894 | A | 8/1997 | Chen et al. |
| 5,669,943 | A | 9/1997 | Horton et al. |
| 5,674,572 | A | 10/1997 | Sarin et al. |
| 5,725,421 | A | 3/1998 | Goers et al. |
| 5,746,931 | A | 5/1998 | Graebner et al. |
| RE35,812 | E | 6/1998 | Oliver |
| 5,772,756 | A | 6/1998 | Davies et al. |
| 5,776,214 | A | 7/1998 | Wood |
| 5,779,743 | A | 7/1998 | Wood |
| 5,791,975 | A | 8/1998 | Cesna et al. |
| 5,801,073 | A | 9/1998 | Robbins et al. |
| 5,816,891 | A | 10/1998 | Woo |
| 5,820,450 | A | 10/1998 | Calhoun |
| 5,833,519 | A | 11/1998 | Moore |
| 5,851,138 | A | 12/1998 | Hempel, Jr. |
| 5,855,314 | A | 1/1999 | Shiue et al. |
| 5,885,137 | A | 3/1999 | Ploessl |
| 5,902,173 | A | 5/1999 | Tanaka |
| 5,916,011 | A | 6/1999 | Kim et al. |
| 5,919,084 | A | 7/1999 | Powell et al. |
| 5,921,856 | A | 7/1999 | Zimmer |
| 5,924,917 | A | 7/1999 | Benedict et al. |
| 5,961,373 | A | 10/1999 | Lai et al. |
| 5,975,988 | A | 11/1999 | Christianson |
| 5,976,001 | A | 11/1999 | Powell et al. |
| 5,976,205 | A | 11/1999 | Andrews et al. |
| 5,980,852 | A | 11/1999 | Burns et al. |
| 5,980,982 | A | 11/1999 | Degawa et al. |

| | | | | |
|---|---|---|---|---|
| 5,985,228 | A | 11/1999 | Corrigan et al. | |
| 6,001,008 | A | 12/1999 | Fujimori et al. | |
| 6,001,174 | A | 12/1999 | Fang | |
| 6,024,824 | A | 2/2000 | Krech | |
| 6,027,659 | A | 2/2000 | Billett | |
| 6,030,595 | A | 2/2000 | Sumiya et al. | |
| 6,039,641 | A | 3/2000 | Sung | |
| 6,054,183 | A | 4/2000 | Zimmer et al. | |
| 6,093,280 | A | 7/2000 | Kirchner et al. | |
| 6,106,382 | A | 8/2000 | Sakaguchi | |
| 6,123,612 | A | 9/2000 | Goers | |
| 6,159,286 | A | 12/2000 | Sung | |
| 6,179,886 | B1 | 1/2001 | Gordeev et al. | |
| 6,190,240 | B1 | 2/2001 | Kinoshita et al. | |
| 6,196,911 | B1 | 3/2001 | Preston et al. | |
| 6,206,942 | B1 | 3/2001 | Wood | |
| 6,213,856 | B1 | 4/2001 | Cho et al. | |
| 6,217,413 | B1 | 4/2001 | Christianson | |
| 6,224,469 | B1 | 5/2001 | Ohmori et al. | |
| 6,258,138 | B1 | 7/2001 | DeVoe et al. | |
| 6,258,201 | B1 | 7/2001 | Krech | |
| 6,258,237 | B1 | 7/2001 | Gal-Or et al. | |
| 6,281,129 | B1 | 8/2001 | Easter et al. | |
| 6,284,556 | B1 | 9/2001 | Wang et al. | |
| 6,286,498 | B1 | 9/2001 | Sung | |
| 6,293,854 | B1 | 9/2001 | Kimura et al. | |
| 6,299,508 | B1 | 10/2001 | Gagliardi et al. | |
| 6,319,108 | B1 | 11/2001 | Adefris et al. | |
| 6,325,709 | B1 | 12/2001 | Nanda et al. | |
| 6,346,202 | B1 | 2/2002 | Molnar | |
| 6,354,918 | B1 | 3/2002 | Togawa et al. | |
| 6,354,929 | B1 | 3/2002 | Adefris et al. | |
| 6,368,198 | B1 | 4/2002 | Sung et al. | |
| 6,371,838 | B1 * | 4/2002 | Holzapfel | 451/72 |
| 6,371,842 | B1 | 4/2002 | Romero | |
| 6,394,886 | B1 | 5/2002 | Chen et al. | |
| 6,409,580 | B1 | 6/2002 | Lougher et al. | |
| 6,439,986 | B1 | 8/2002 | Myoung et al. | |
| 6,446,740 | B2 | 9/2002 | Eyre | |
| 6,458,018 | B1 | 10/2002 | Gores et al. | |
| 6,478,831 | B2 | 11/2002 | Tselesin | |
| 6,497,853 | B1 | 12/2002 | Davies et al. | |
| 6,544,599 | B1 | 4/2003 | Brown et al. | |
| 6,551,176 | B1 | 4/2003 | Garretson | |
| 6,605,798 | B1 | 8/2003 | Cullen | |
| 6,607,423 | B1 | 8/2003 | Arcayan et al. | |
| 6,616,725 | B2 | 9/2003 | Cho et al. | |
| 6,626,167 | B2 | 9/2003 | Kim et al. | |
| 6,627,168 | B1 | 9/2003 | Ohtsubo et al. | |
| 6,672,943 | B2 | 1/2004 | Vogtmann et al. | |
| 6,679,243 | B2 | 1/2004 | Sung | |
| 6,694,847 | B2 | 2/2004 | Hiroyasu et al. | |
| 6,722,952 | B2 | 4/2004 | Goers et al. | |
| 6,749,485 | B1 | 6/2004 | James et al. | |
| 6,755,720 | B1 | 6/2004 | Ishizaki et al. | |
| 6,790,126 | B2 | 9/2004 | Wood et al. | |
| 6,818,029 | B2 | 11/2004 | Myoung et al. | |
| 6,824,455 | B2 | 11/2004 | Osterheld et al. | |
| 6,835,365 | B1 | 12/2004 | Stewart et al. | |
| 6,884,155 | B2 | 4/2005 | Sung | |
| 6,899,592 | B1 * | 5/2005 | Kojima et al. | 451/6 |
| 6,905,571 | B2 | 6/2005 | Sakuma et al. | |
| 6,945,857 | B1 | 9/2005 | Doan et al. | |
| 6,979,357 | B2 | 12/2005 | Fries et al. | |
| 7,021,995 | B2 | 4/2006 | Toge et al. | |
| 7,033,408 | B2 | 4/2006 | Fries et al. | |
| 7,044,990 | B2 | 5/2006 | Ishizaki et al. | |
| 7,066,795 | B2 * | 6/2006 | Balagani et al. | 451/285 |
| 7,124,753 | B2 | 10/2006 | Sung | |
| 7,150,677 | B2 * | 12/2006 | Yamashita et al. | 451/443 |
| 7,198,553 | B2 | 4/2007 | Goers | |
| 7,201,645 | B2 | 4/2007 | Sung | |
| 7,247,577 | B2 | 7/2007 | Palmgren et al. | |
| 7,258,708 | B2 | 8/2007 | Sung | |
| 7,261,621 | B2 * | 8/2007 | Moon et al. | 451/287 |
| 7,323,049 | B2 | 1/2008 | Sung | |
| 7,368,013 | B2 | 5/2008 | Sung | |
| 7,384,436 | B2 | 6/2008 | Sung | |
| 7,404,857 | B2 | 7/2008 | Sung | |
| 7,465,217 | B2 | 12/2008 | Kinoshita et al. | |
| 7,585,366 | B2 | 9/2009 | Sung | |
| 7,641,538 | B2 | 1/2010 | Goers | |
| 7,651,386 | B2 | 1/2010 | Sung | |
| 7,658,666 | B2 | 2/2010 | Sung | |
| 7,690,971 | B2 | 4/2010 | Sung | |
| 7,840,305 | B2 | 11/2010 | Behr et al. | |
| 8,104,464 | B2 | 1/2012 | Sung | |
| 2001/0003884 | A1 | 6/2001 | Wei et al. | |
| 2001/0009844 | A1 | 7/2001 | Cho et al. | |
| 2002/0042200 | A1 | 4/2002 | Fawcett | |
| 2002/0127962 | A1 | 9/2002 | Cho et al. | |
| 2002/0164928 | A1 | 11/2002 | Tolles | |
| 2002/0173234 | A1 | 11/2002 | Sung et al. | |
| 2003/0054746 | A1 | 3/2003 | Nussbaumer | |
| 2003/0084894 | A1 | 5/2003 | Sung | |
| 2003/0114094 | A1 | 6/2003 | Myoung et al. | |
| 2003/0207659 | A1 | 11/2003 | Annen et al. | |
| 2004/0009742 | A1 | 1/2004 | Lin et al. | |
| 2004/0060243 | A1 | 4/2004 | Fries et al. | |
| 2004/0079033 | A1 | 4/2004 | Long | |
| 2004/0091627 | A1 | 5/2004 | Ohara et al. | |
| 2004/0107648 | A1 | 6/2004 | Sung | |
| 2004/0180617 | A1 * | 9/2004 | Goers | 451/443 |
| 2005/0032462 | A1 | 2/2005 | Gagliardi et al. | |
| 2005/0060941 | A1 | 3/2005 | Provow | |
| 2005/0118939 | A1 | 6/2005 | Duescher | |
| 2005/0215188 | A1 | 9/2005 | Toge et al. | |
| 2005/0260939 | A1 | 11/2005 | Andrews et al. | |
| 2006/0073774 | A1 | 4/2006 | Sung | |
| 2006/0079160 | A1 * | 4/2006 | Balagani et al. | 451/285 |
| 2006/0079162 | A1 | 4/2006 | Yamashita et al. | |
| 2006/0128288 | A1 | 6/2006 | An et al. | |
| 2006/0135050 | A1 | 6/2006 | Petersen et al. | |
| 2006/0143991 | A1 | 7/2006 | Sung | |
| 2006/0254154 | A1 | 11/2006 | Huang et al. | |
| 2006/0258276 | A1 | 11/2006 | Sung | |
| 2007/0051355 | A1 | 3/2007 | Sung | |
| 2007/0060026 | A1 | 3/2007 | Sung | |
| 2007/0066194 | A1 * | 3/2007 | Wielonski et al. | 451/443 |
| 2007/0093181 | A1 | 4/2007 | Lugg et al. | |
| 2007/0128994 | A1 | 6/2007 | Sung | |
| 2007/0155298 | A1 | 7/2007 | Sung | |
| 2007/0249270 | A1 | 10/2007 | Sung | |
| 2007/0254566 | A1 | 11/2007 | Sung | |
| 2007/0264918 | A1 | 11/2007 | Sung | |
| 2007/0266639 | A1 | 11/2007 | Sung | |
| 2007/0295267 | A1 | 12/2007 | Sung | |
| 2008/0076338 | A1 * | 3/2008 | Andrews et al. | 451/443 |
| 2008/0096479 | A1 | 4/2008 | Sung | |
| 2008/0153398 | A1 | 6/2008 | Sung | |
| 2008/0171503 | A1 | 7/2008 | Sung | |
| 2008/0271384 | A1 | 11/2008 | Puthanangady et al. | |
| 2008/0292869 | A1 | 11/2008 | Sung | |
| 2009/0068937 | A1 | 3/2009 | Sung | |
| 2009/0093195 | A1 | 4/2009 | Sung | |
| 2009/0145045 | A1 | 6/2009 | Sung | |
| 2009/0283089 | A1 | 11/2009 | Sung | |
| 2010/0015898 | A1 * | 1/2010 | An et al. | 451/443 |
| 2010/0139174 | A1 | 6/2010 | Sung | |
| 2010/0186479 | A1 | 7/2010 | Borucki et al. | |
| 2010/0203811 | A1 | 8/2010 | Philipossian et al. | |
| 2010/0221990 | A1 | 9/2010 | Sung | |
| 2010/0248595 | A1 | 9/2010 | Dinh-Ngoc et al. | |
| 2010/0248596 | A1 | 9/2010 | Sung | |
| 2010/0261419 | A1 | 10/2010 | Sung | |
| 2011/0212670 | A1 | 9/2011 | Sung | |
| 2011/0275288 | A1 | 11/2011 | Sung | |
| 2011/0296766 | A1 | 12/2011 | Sung | |

FOREIGN PATENT DOCUMENTS

| | | |
|---|---|---|
| EP | 0712941 | 5/1966 |
| EP | 0238434 | 3/1987 |
| EP | 0280657 | 8/1988 |
| EP | 0331344 | 2/1989 |
| EP | 0264674 | 9/1995 |
| EP | 1075898 | 2/2001 |
| GB | 2239011 | 6/1991 |
| JP | 06182184 | 4/1994 |

| | | |
|---|---|---|
| JP | 10128654 | 5/1998 |
| JP | 10180618 | 7/1998 |
| JP | 11048122 | 2/1999 |
| JP | 11077536 | 3/1999 |
| JP | 200167774 | 6/2000 |
| JP | 2000343436 | 12/2000 |
| JP | 2003-071718 | 3/2003 |
| JP | 2004/025401 | 1/2004 |
| JP | 2007-044823 | 2/2007 |
| KR | 20-0339181 | 1/2004 |
| WO | WO94/27883 | 12/1994 |
| WO | WO95/27596 | 10/1995 |
| WO | WO96/06732 | 3/1996 |
| WO | WO98/10897 | 3/1998 |
| WO | WO98/45091 | 3/1998 |
| WO | WO98/51448 | 3/1998 |
| WO | WO 02/31078 | 4/2002 |
| WO | WO2004/094106 | 11/2004 |
| WO | WO 2006/124792 | 11/2006 |
| WO | WO2006/124792 | 11/2006 |
| WO | WO 2007/032946 | 3/2007 |
| WO | WO 2008/063599 | 5/2008 |

OTHER PUBLICATIONS

U.S. Appl. No. 11/805,549, filed May 22, 2007, Chien-Min Sung, Office Action issued Oct. 6, 2010.
Sung, U.S. Appl. No. 11/512,755, office action issued Oct. 13, 2009.
U.S. Appl. No. 12/715,583, filed Mar. 2, 2010; Chien-Min Sung; office action issued Oct. 25, 2011.
U.S. Appl. No. 12/267,172, filed Nov. 7, 2008; Chien-Min Sung; office action issued Jan. 3, 2012.
Sung, U.S. Appl. No. 12/255,823, filed Oct. 22, 2008.
U.S. Appl. No. 13/021,350, filed Feb. 4, 2011; Chien-Min Sung; office action issued Feb. 7, 2012.
U.S. Appl. No. 12/328,338, filed Dec. 4, 2008; Chien-Min Sung; office action issued May 10, 2011.
Syndite, elementsix advacing diamond, 2 pages.
U.S. Appl. No. 13/021,350, filed Feb. 4, 2011; Chien-Min Sung; office action issued Aug. 31, 2011.
U.S. Appl. No. 12/255,823, filed Oct. 22, 2005; Chien-Min Sung; office action issued Mar. 7, 2012.
U.S. Appl. No. 12/715,583, filed Mar. 2, 2010; Chien-Min Sung; office action issued Mar. 21, 2012.
Colmonoy Technical Data Sheet; no. DSP-A; 1993.
Endecott's Specifications; 2004.
Kennametal Specification for DMHPM002 Hot Press Matrix N-50 Dec. 6, 2001.
Material Safety Data Sheet (MSDS), Wall Colmonoy Corporation; prepared Jul. 20, 1989.
Material Safety Data Sheet MSDS); Kennametal; issued Jun. 11, 2004.
PCT Application PCT/US2011/052627; filed Sep. 21, 2011Chien-Min Sung; International Search Report mailed May 11, 2011.
Sung et al.; The Eastern Wind of Diamond Synthesis; New Diamond and Frontier Carpon Technology; 2003; pp. 47-61; vol. 13, No. 1.
Sung et al; Mechanism of the Solvent-Assisted Graphite to Diamond Transition Under High Pressure: Implications for the Selection of Catalysts, High Temperatures-High Pressure; 1995/1996; pp. 523-546; vol. 27/28.
Syndite, CTM302; Announcement, Elementsix Advancing Diamond; Jan. 14, 2003; http://www.e6.com/en/resourches/announcementsheets/CTM302.pdf; as accessed on Dec. 16, 2008.
Syndite, Elementsix Advancing Diamond; 2 pages no date, referenced in related application.
U.S. Appl. No. 08/832,852; filed Apr. 4, 1997; Chien-Min Sung.
U.S. Appl. 09/447,620; filed Nov. 22, 1999; Chien-Min Sung.
U.S. Appl. No. 11/512,755; filed Aug. 29, 2006; Chien-Min Sung.
U.S. Appl. No. 13/239,198; filed Sep. 21, 2011; Chien-Min Sung.
U.S. Appl. No. 13/021,350; filed Feb. 4, 2011; Chien-Min Sung; office action issued Aug. 10, 2012.
U.S. Appl. No. 12/715,583; filed Mar. 2, 2010; Chien-Min Sung; office action issued Aug. 9, 2012.
U.S. Appl. No. 12/267,172; filed Nov. 7, 2008; Chien-Min Sung; office action issued Jul. 9, 2012.
U.S. Appl. No. 13/362,917; filed Jan. 31, 2012; Chien-Min Sung; office action issued Jun. 14, 2012.
U.S. Appl. No. 12/255,823; filed Oct. 22, 2008; Chien-Min Sung; Notice of Allowance issued Sep. 21, 2012.
U.S. Appl. No. 12/267,172; filed Nov. 7, 2008; Chien-Min Sung; notice of allowance issued Oct. 22, 2012.
U.S. Appl. No. 12/715,583; filed Mar. 2, 2010; Chien-Min Sung; notice of allowance dated Dec. 7, 2012.
PCT/US2012/039199; filed May 23, 2012; Chien-Min Sung; International Search Report dated Dec. 18, 2012.
U.S. Appl. No. 12/255,823; filed Oct. 22, 2008; Chien-Min Sung; notice of allowance dated Dec. 16, 2012.
U.S. Appl. No. 13/362,917; filed Jan. 13, 2012; Chien-Min Sung; office action dated Dec. 31, 2012.
U.S. Appl. No. 12/267,172; filed Nov. 7, 2008; Chien-Min Sung; notice of allowance dated Jan. 7, 2013.

* cited by examiner

CMP PAD CONDITIONERS WITH MOSAIC ABRASIVE SEGMENTS AND ASSOCIATED METHODS

PRIORITY CLAIM

This application claims the benefit of U.S. Provisional Patent Application Ser. No. 60/976,198, filed Sep. 28, 2007; this application is also a continuation-in-part of U.S. patent application Ser. No. 11/560,817, filed Nov. 16, 2006 now U.S. Pat. No. 7,762,872, each of which are hereby incorporated herein by reference.

FIELD OF THE INVENTION

The present invention relates generally to CMP pad conditioners used to remove material from (e.g., smooth, polish, dress, etc.) CMP pads. Accordingly, the present invention involves the fields of chemistry, physics, and materials science.

BACKGROUND OF THE INVENTION

The semiconductor industry currently spends in excess of one billion U.S. Dollars each year manufacturing silicon wafers that must exhibit very flat and smooth surfaces. Known techniques to manufacture smooth and even-surfaced silicon wafers are plentiful. The most common of these involves the process known as Chemical Mechanical Polishing (CMP) which includes the use of a polishing pad in combination with an abrasive slurry. Of central importance in all CMP processes is the attainment of high performance levels in aspects such as uniformity of polished wafer, smoothness of the IC circuitry, removal rate for productivity, longevity of consumables for CMP economics, etc.

SUMMARY OF THE INVENTION

In accordance with one embodiment, the present invention provides a CMP pad conditioner, including a plurality of abrasive segments. Each abrasive segment can include a segment blank and an abrasive layer attached to the segment blank. The abrasive layer can include a superhard abrasive material. A pad conditioner substrate is also provided and each of the plurality of abrasive segments can be permanently affixed to the pad conditioner substrate in an orientation that enables removal of material from a CMP pad by the abrasive layer as the pad conditioner and the CMP pad are moved relative to one another.

In accordance with another aspect of the invention, a CMP pad conditioner is provided, including a plurality of abrasive segments. Each abrasive segment can include a segment blank, an organic adhesive layer, and an abrasive layer attached to the segment blank by the organic adhesive layer. The abrasive layer can include a superhard abrasive material. A pad conditioner substrate is also provided, with each of the plurality of abrasive segments being permanently affixed to the pad conditioner substrate in an orientation that enables removal of material from a CMP pad by the abrasive layer as the pad conditioner and the CMP pad are moved relative to one another.

In accordance with another aspect of the invention, a CMP pad conditioner is provided, including a plurality of abrasive segments. Each abrasive segment can include a segment blank and an abrasive layer attached to the segment blank by a brazing alloy. The abrasive layer can include a superhard abrasive material. A pad conditioner substrate is also provided, with each of the plurality of abrasive segments being permanently affixed to the pad conditioner substrate in an orientation that enables removal of material from a CMP pad by the abrasive layer as the pad conditioner and the CMP pad are moved relative to one another.

In accordance with another aspect of the invention, a CMP pad conditioner is provided, including a plurality of abrasive segments. Each abrasive segment can include a segment blank and an abrasive layer attached to the segment blank. The abrasive layer can include a superhard abrasive blade. A pad conditioner substrate is also provided, with each of the plurality of abrasive segments being permanently affixed to the pad conditioner substrate in an orientation that enables removal of material from a CMP pad by the abrasive layer as the pad conditioner and the CMP pad are moved relative to one another.

In accordance with another aspect of the invention, a CMP pad conditioner is provided, including a plurality of abrasive segments. Each abrasive segment can include a segment blank and an abrasive layer attached to the segment blank. The abrasive layer can include a cutting face angled at 90 degrees or less relative to a finished surface to be applied to the CMP pad. A pad conditioner substrate is also provided, with each of the plurality of abrasive segments being permanently affixed to the pad conditioner substrate in an orientation that enables removal of material from a CMP pad by the abrasive layer as the pad conditioner and the CMP pad are moved relative to one another.

In accordance with another aspect of the invention, a method of forming a CMP pad conditioner is provided, including: obtaining at least one abrasive segment, the abrasive segment including: a segment blank; and an abrasive layer attached to the segment blank, the abrasive layer including a superhard abrasive material. The method can include positioning the at least one abrasive segment on a face of a pad conditioner substrate in an orientation that enables removal of material from a CMP pad by the abrasive layer as the pad conditioner and the CMP pad are moved relative to one another; and permanently affixing the at least one abrasive segment to the pad conditioner substrate.

There has thus been outlined, rather broadly, various features of the invention so that the detailed description thereof that follows may be better understood, and so that the present contribution to the art may be better appreciated. Other features of the present invention will become clearer from the following detailed description of the invention, taken with any accompanying or following claims, or may be learned by the practice of the invention.

Figure 1:
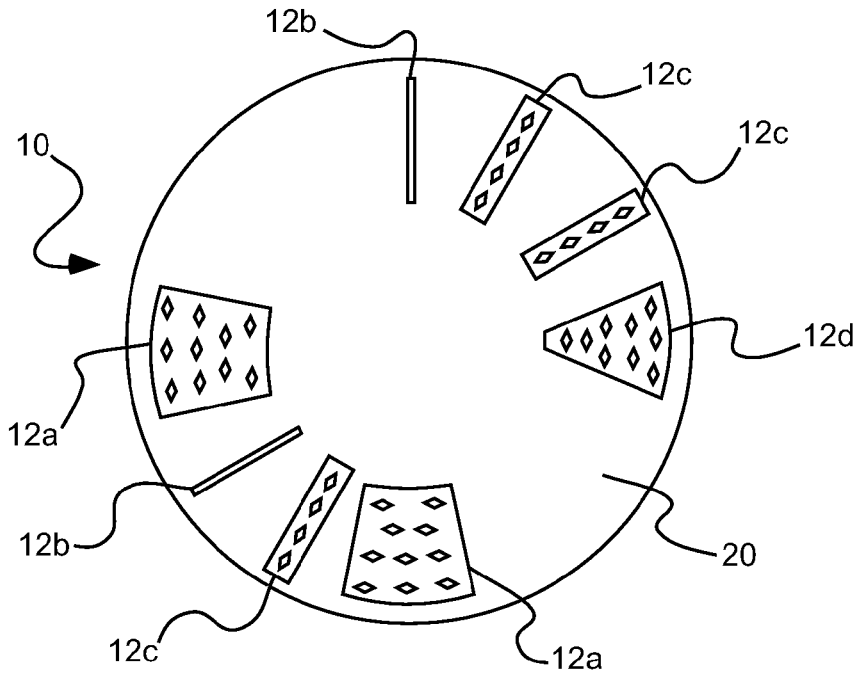
FIG. 1 is a schematic, top plan view of an exemplary pad conditioner in accordance with an embodiment of the invention.

It will be understood that the above figures are merely for illustrative purposes in furthering an understanding of the invention. Further, the figures may not be drawn to scale, thus dimensions, particle sizes, and other aspects may, and generally are, exaggerated to make illustrations thereof clearer. For example, an abrasive layer is illustrated in some of the figures as including a plurality of abrasive particles: however, many of the specific embodiments disclosed herein do not necessarily include abrasive particles. Therefore, it will be appreciated that departure can and likely will be made from the specific dimensions and aspects shown in the figures in order to produce the pad conditioners of the present invention.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and any appended or following claims, the singular forms "a," "an" and "the" include plural referents unless the context clearly dictates otherwise. Thus, for example, reference to "an abrasive segment" can include one or more of such segments.

Definitions

In describing and claiming the present invention, the following terminology will be used in accordance with the definitions set forth below.

All mesh sizes that may be referred to herein are U.S. mesh sizes unless otherwise indicated. Further, mesh sizes are generally understood to indicate an average mesh size of a given collection of particles since each particle within a particular "mesh size" may actually vary over a small distribution of sizes.

As used herein, the term "substantially" refers to the complete or nearly complete extent or degree of an action, characteristic, property, state, structure, item, or result. As an arbitrary example, when two or more objects are referred to as being spaced a "substantially" constant distance from one another, it is understood that the two or more objects are spaced a completely unchanging distance from one another, or so nearly an unchanging distance from one another that a typical person would be unable to appreciate the difference. The exact allowable degree of deviation from absolute completeness may in some cases depend upon the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, a cavity that is "substantially free of" foreign matter would either completely lack any foreign matter, or so nearly completely lack foreign matter that the effect would be the same as if it completely lacked foreign matter. In other words, a cavity that is "substantially free of" foreign matter may still actually contain minute portions of foreign matter so long as there is no measurable effect upon the cavity as a result thereof.

As used herein, a pad conditioner "substrate" means a portion of a pad conditioner that supports abrasive materials, and to which abrasive materials and/or segment blanks that carry abrasive materials may be affixed. Substrates useful in the present invention may of a variety of shapes, thicknesses, or materials that are capable of supporting abrasive materials in a manner that is sufficient to provide a pad conditioner useful for its intended purpose. Substrates may be of a solid material, a powdered material that becomes solid when processed, or a flexible material. Examples of typical substrate materials include without limitation, metals, metal alloys, ceramics, relatively hard polymers or other organic materials, glasses, and mixtures thereof. Further, the substrate may include a material that aids in attaching abrasive materials to the substrate, including, without limitation, brazing alloy material, sintering aids and the like.

As used herein, "segment blank" refers to a structure similar in many respects to the pad conditioner substrates defined above. Segment blanks are utilized in the present invention to carry abrasive layers: attachment of the abrasive layers to the pad conditioner substrates is typically achieved by way of attaching the segment blanks to the pad conditioner substrates. It is important to note that a variety of manners of attaching the segment blanks to the substrates, and a variety of manners of attaching the abrasive layers to the segment blanks, are discussed herein. It is to be understood that all of these various attachment mechanisms can be used interchangeably herein: that is, if a method of attaching a segment blank to a substrate is discussed herein, the method of attachment discussed can also be used to attach an abrasive layer to a segment blank. For any particular CMP pad dresser being discussed, however, it is understood that attachment methods of the abrasive layers to the segment blanks can differ from, or can be the same as, the method used to attach the segment blanks to the pad conditioner substrate.

As used herein, "geometric configuration" refers to a shape that is capable of being described in readily understood and recognized mathematical terms. Examples of shapes qualifying as "geometric configurations" include, without limitation, cubic shapes, polyhedral (including regular polyhedral) shapes, triangular shapes (including equilateral triangles, isosceles triangles and three-dimensional triangular shapes), pyramidal shapes, spheres, rectangles, "pie" shapes, wedge shapes, octagonal shapes, circles, etc.

As used herein, "vapor deposition" refers to a process of depositing materials on a substrate through the vapor phase. Vapor deposition processes can include any process such as, but not limited to, chemical vapor deposition (CVD) and physical vapor deposition (PVD). A wide variety of variations of each vapor deposition method can be performed by those skilled in the art. Examples of vapor deposition methods include hot filament CVD, rf-CVD, laser CVD (LCVD), metal-organic CVD (MOCVD), sputtering, thermal evaporation PVD, ionized metal PVD (IMPVD), electron beam PVD (EBPVD), reactive PVD, and the like.

As used herein, "abrasive profile" is to be understood to refer to a shape, configuration, or a space defined by abrasive materials that can be used to remove material from a CMP pad. Examples of abrasive profiles include, without limitation, rectangular shapes, tapering rectangular shapes, truncated wedge shapes, wedge shapes, a "saw tooth" profile and the like. In some embodiments, the abrasive profile exhibited by abrasive segments of the present invention will apparent when viewed through a plane in which the CMP pad will be oriented during removal of material from the CMP pad.

As used herein, an "abrading surface or point" may be used to refer to a surface, edge, face, point or peak of an abrasive segment that contacts and removes material from a CMP pad. Generally speaking, the abrading surface or point is the portion of the abrasive segment that first contacts the CMP pad as the abrasive segment and the CMP pad are brought into contact with one another.

As used herein, "superhard" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN), corundum and sapphire, as well as other superhard materials known to those skilled in the art. Superhard materials may be incorporated into the present invention in a variety of forms including particles, grits, films, layers, pieces, segments, etc. In some cases, the superhard materials of the present invention are in the form of polycrystalline superhard materials, such as PCD and PcBN materials.

As used herein, "organic material" refers to a semisolid or solid complex or mix of organic compounds. As such, "organic material layer" and "organic material matrix" may be used interchangeably, refer to a layer or mass of a semisolid or solid complex amorphous mix of organic compounds, including resins, polymers, gums, etc. Preferably the organic material will be a polymer or copolymer formed from the polymerization of one or more monomers. In some cases, such organic material may be adhesive.

As used herein, the process of "brazing" is intended to refer to the creation of chemical bonds between the carbon atoms of the superabrasive particles/materials and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not necessarily require the presence of a carbide former.

As used herein, "particle" and "grit" may be used interchangeably.

As used herein, an "abrasive layer" describes a variety of structures capable of removing (e.g., cutting, polishing, scraping) material from a CMP pad. An abrasive layer can include a mass having several cutting points, ridges or mesas formed thereon or therein. It is notable that such cutting points, ridges or mesas may be from a multiplicity of protrusions or asperities included in the mass. Furthermore, an abrasive layer can include a plurality of individual abrasive particles that may have only one cutting point, ridge or mesa formed thereon or therein. An abrasive layer can also include composite masses, such as PCD pieces, segment or blanks, either individually comprising the abrasive layer or collectively comprising the abrasive layer.

As used herein, "metallic" includes any type of metal, metal alloy, or mixture thereof, and specifically includes but is not limited to steel, iron, and stainless steel.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, particle sizes, volumes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The Invention

The present invention generally provides pad conditioners and associated methods that can be utilized in conditioning (e.g., smoothing, polishing, dressing) or otherwise affecting a CMP pad to remove material from the CMP pad in order to provide a finished, smooth and/or flat surface to the pad. Pad conditioners of the present invention can be advantageously utilized, for example, in dressing CMP pads that are used in polishing, finishing or otherwise affecting silicon wafers.

Figure 1A:
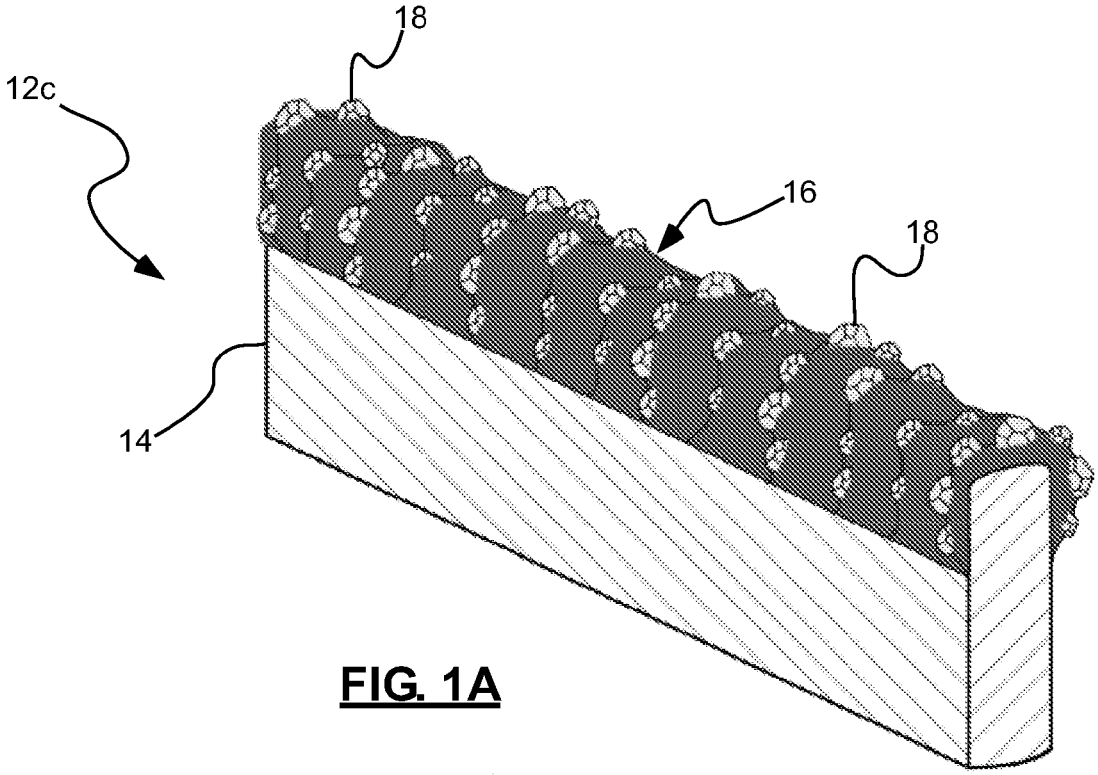
FIG. 1A is an enlarged, perspective schematic view of an exemplary abrasive segment that can be used in the pad conditioner of FIG. 1.

In the embodiment of the invention illustrated in FIG. 1, a CMP pad conditioner 10 is provided. The pad conditioner can include at least one abrasive segment 12*a*, 12*b*, 12*c* and 12*d* (sometimes the varied and numerous abrasive segments discussed herein are collectively referred to as "12*x*"). As best appreciated from the example shown in FIG. 1A, each abrasive segment 12 can include a segment blank 14 and an abrasive layer 16 attached to the segment blank. The abrasive layer 16 can include a superhard abrasive material: in the exemplary embodiment of FIG. 1A, the superhard abrasive material includes a plurality of superhard particles 18. A pad conditioner substrate 20 (FIG. 1) can also be provided. The pad conditioner substrate can vary according to the applications for which the pad conditioner is designed, but generally includes a face on which the abrasive segments can be affixed to allow the pad conditioner to be used to grind, plane, cut or otherwise remove material from a CMP pad (not shown).

The at least one abrasive segment 12*x* can be permanently fixed to the pad conditioner 20 in an orientation that enables removal of material from the CMP pad by the abrasive layer as the pad conditioner and the pad are moved relative to one another. For example, in the embodiment shown in FIG. 1, the abrasive segments 12*x* are arranged radially along an edge of a substantially circular pad conditioner substrate. Such an arrangement has been found well suited to remove material from a CMP pad (while "dressing" the pad) by rotating the pad conditioner substrate relative to the pad.

The present invention provides a number of advantages over conventional devices. One such advantage lies in the ability to customize methods of attachment of the abrasive layer 16 to the segment blank 14 independently of methods of attachment of the segment blank or blanks to the pad conditioner substrate. For example, as various attachment methods may involve very high temperatures and/or pressures, very demanding environmental conditions, or simply are very labor intensive when attempted with pad conditioners of large or complex surface areas, performing the attachment method on distinct, easily handled segment blanks can improve costs, efficiencies and integrities of the attachment process. Also, leveling of the components of the abrasive layer on each segment blank can be performed more easily when done in discrete, relatively small lots. The resulting plurality of abrasive segments can likewise be more easily positioned, leveled, spaced, oriented, etc., across the face of the pad conditioner substrate 20 after the abrasive layer is individually attached to each of the abrasive segments.

In addition, by obtaining a plurality of abrasive segments 12*x*, each with an abrasive layer 16 already attached thereto, an abrasive pattern across the face of the pad conditioner substrate 20 can be designed to optimize various conditioning procedures. For example, the spacing between adjacent abrasive segments can be carefully selected to aid in, or better control, the flow of various fluids (e.g., slurry) around and through the abrasive segments to increase the efficacy and efficiency of the material removing process. Also, as shown in FIG. 1, segment blanks having differing abrasive profiles (e.g., different sizes, shapes, abrasive aggressiveness, etc.) can be used on a single substrate, to enable customization of an abrading profile of the pad conditioner as a whole.

As will be discussed in further detail below, not only can the abrasive profile of each abrasive segment be customized, the type of, or composition of, the abrasive segment can vary from one segment 12*x* to another. For example, segment 12*c* may include a plurality of individual abrasive grits 18 attached to the segment blank 14 via an organic adhesive material layer 16. Segment 12*a* can include a substantially continuous piece of PCD compact attached to a segment blank via a differing attachment mechanism. Also, relative height or elevation of abrasive segments can be varied on any particular pad dresser. For example, the abrasive segment 12*a* of FIG. 1 can be elevated slightly higher than or lower than abrasive segment 12*c* of FIG. 1.

The various segment blanks 14 shown and discussed herein can be formed from a variety of materials, including, without limitation, metallic materials such as aluminum, copper, steel, metal alloys, etc., ceramic materials, glasses, polymers, composite materials, etc. Generally speaking, virtually any material to which an abrasive segment 12*x* can be attached will suffice.

In some embodiments, the material of the segment blank can be chosen to provide superior results during the process of attaching the abrasive layer thereto. As discussed above, the abrasive layer can be attached to the segment blank in a variety of manners, including epoxy bonding methods (e.g., organic bonding methods), metal brazing, sintering, electrodeposition, etc. The material of the segment blank can be chosen based upon the attachment process anticipated. For example, a segment blank formed partially or fully from nickel, or stainless steel, can be utilized in some processes involving brazing and/or sintering. Also, ceramic or metallic materials might be utilized in organic attachment methods.

Various embodiments of the invention employ various methods of attachment of the abrasive layer 16 to the segment blank 14. In one embodiment, an organic material layer can be deposited on the segment blank, and one or more abrasive particles, chips, segments, etc., can be fixed to the segment blank by way of the organic material layer. Examples of suitable organic materials include, without limitation, amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

So-called "reverse casting" methods can be used to accurately and controllably orient and attach the abrasive material on the segment blank (and to orient and attach the segment blanks to the pad conditioner substrate). Such methods can include initially securing a superabrasive material, e.g., a plurality of superabrasive grits, to a substrate using a "mask" material. The portions of the particles protruding from the mask material can then be attached to a pad conditioner substrate using the methods discussed herein, after which (or during which), the masking material can be removed. It has been found that these reverse casting techniques can increase the amount of abrasive particles (or other abrasive contact points) to as much as 10% and more of the total amount of abrasive particles or contact points.

Suitable reverse casting methods can be found in various patents and patent applications to the present inventor, including U.S. Patent Application Ser. No. 60/992,966, filed Dec. 6, 2007; U.S. patent application Ser. No. 11/804,221, filed May 16, 2007; and U.S. patent application Ser. No. 11/805,549, filed May 22, 2007, each of which is hereby incorporated herein by reference. These techniques can be used when attaching the abrasive segments of the present invention to pad conditioner substrate: and when attaching the abrasive layers of the present invention to the segment blanks. Such techniques allow very precise control of lateral placement of the abrasive segments or abrasive layers, as well as very precise control of relative elevation of the abrasive segments or abrasive layers.

When an organic bonding material layer is utilized, methods of curing the organic material layer can be a variety of processes known to one skilled in the art that cause a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art.

In one aspect of the present invention, the organic material layer may be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process can be essentially irreversible, if desired.

Organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite™ trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin. In yet another aspect, the organic material may be a polyurethane resin.

Numerous additives may be included in the organic material to facilitate its use. For example, additional crosslinking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the individual abrasive segments. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of each superabrasive material to facilitate the retention of the superabrasive material in the organic material via chemical bonding. A wide variety of organic and organometallic compounds is known to those of ordinary skill in the art and may be used. Organometallic coupling agents can form chemicals bonds between the superabrasive materials and the organic material matrix, thus increasing the retention of the superabrasive materials therein. In this way, the organometallic coupling agent can serve as a bridge to form bonds between the organic material matrix and the surface of the superabrasive material. In one aspect of the present invention, the organometallic coupling agent can be a titanate, zirconate, silane, or mixture thereof.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K.K., etc.).

Specific non-limiting examples of titanate coupling agents include: isopropyltriisostearoyl titanate, di(cumylphenylate) oxyacetate titanate, 4-aminobenzenesulfonyldodecylbenzenesulfonyl titanate, tetraoctylbis (ditridecylphosphite) titanate, isopropyltri(N-ethylamino-ethylamino) titanate (available from Kenrich Petrochemicals. Inc.), neoalkyoxy titanates such as LICA-01, LICA-09, LICA-28, LICA-44 and LICA-97 (also available from Kenrich), and the like.

Specific non-limiting examples of aluminum coupling agents include acetoalkoxy aluminum diisopropylate (available from Ajinomoto K.K.), and the like.

Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

The amount of organometallic coupling agent used can depend upon the coupling agent and on the surface area of the superabrasive material. Oftentimes, 0.05% to 10% by weight of the organic material layer can be sufficient.

Metal brazing can also be utilized to attach the abrasive layer 16 to the segment blank 14. Metal brazing techniques are known in the art. For example, in fabricating a diamond saw blade, the process can include mixing diamond particles (e.g., 40/50 U.S. mesh saw grit) with a suitable metal support matrix (bond) powder (e.g., cobalt powder of 1.5 micrometer in size). The mixture is then compressed in a mold to form the right shape (e.g., a saw segment). This "green" form of the tool can then be consolidated by sintering at a temperature between 700-1200 degrees C. to form a single body with a plurality of abrasive particles disposed therein. Finally, the consolidated body can be attached (e.g., by brazing) to a tool body; such as the round blade of a saw, to form the final product. Many other exemplary uses of this technology are known to those having ordinary skill in the art.

Various sintering methods can also be utilized to attach the abrasive layer 16 to the segment blank 14. Suitable sintering methods will be easily appreciated by one of ordinary skill in the art having possession of this disclosure.

The abrasive layer 16 can also be attached to the segment blank 14 by way of known electroplating and/or electrodeposition processes. As an example (not shown in the figures) of a suitable method for positioning and retaining abrasive materials prior to and during the electrodeposition process, a mold can be used that includes an insulating material that can effectively prevent the accumulation of electrodeposited material on the molding surface. Abrasive particles can be held on the molding surface of the mold during electrodeposition. As such, the accumulation of electrodeposited material can be prevented from occurring on the particle tips and the working surface of the pad conditioner substrate. Such techniques are described in U.S. patent application Ser. No. 11/292,938, filed Dec. 2, 2005, which is hereby incorporated herein by reference.

One or more apertures can extend through the insulating material to allow for circulation of an electrolytic fluid from an area outside the mold through the mold and to the surface of the pad conditioner substrate in order to effect electrodeposition of the material used to secure the abrasive particles to the pad conditioner substrate. Such circulation can be advantageous as it is generally necessary to keep a sufficient concentration of the ions (not shown) in an electrolytic fluid at the location of electrodeposition. Other well known techniques can also be utilized, it being understood that the above-provided example is only one of many suitable techniques.

The segment blank can similarly be attached to the pad conditioner substrate in a variety of manners. Depending upon the material from which the segment blank is formed, various manners of fixing the segment blank to the pad conditioner substrate may be utilizing. Suitable attachment methods include, without limitation, organic binding, brazing, welding, etc.

The geometric configuration of the abrasive segment 12 can vary. In the embodiment illustrated in FIGS. 1A and 1B, the abrasive segment includes a generally rectangular segment blank 14 with a layer 16 of abrasive material (that can include abrasive particles 18) attached to an upper portion thereof. The size of the segment blank can vary. In one aspect of the invention, segment size can be adjusted to achieve uniform distribution of diamond grits about an annular ring array. Each segment can contain up to about a thousand diamond grits with pitch set from 3× to 10× of the diamond size. Smaller segments can be better distributed to share the loading during dressings.

Figure 1B:
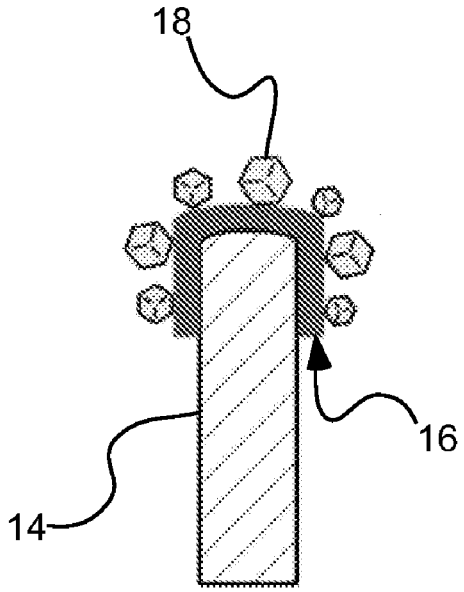
FIG. 1B is an end, schematic view of the abrasive segment of FIG. 1A, shown with one exemplary abrasive profile.
Figure 1C:
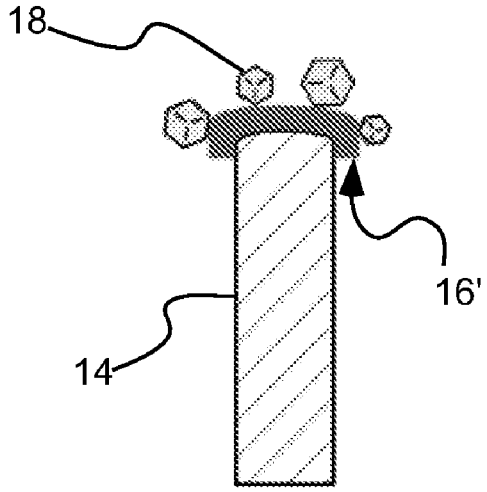
FIG. 1C is an end, schematic view of the abrasive segment of FIG. 1A, shown with another exemplary abrasive profile.

As will be appreciated, in the embodiment of FIG. 1B, the layer 16 of abrasive material extends partially onto (or "down") side edges of the segment blank 14. In the embodiment of FIG. 1C, the abrasive layer extends onto (or down) the side edges to a much lesser degree. The modular nature of the present systems allows a great deal of flexibility in attaching the abrasive layer 16 to the segment blanks 14. As the segment blanks can be prepared separately from the pad conditioner substrate, a variety of manufacturing advantages can be realized when applying the abrasive layer to the segment blank, without regard to the size, shape, mass, material, etc., of the pad conditioner substrate to which the segment blanks will eventually be attached.

Figure 2:
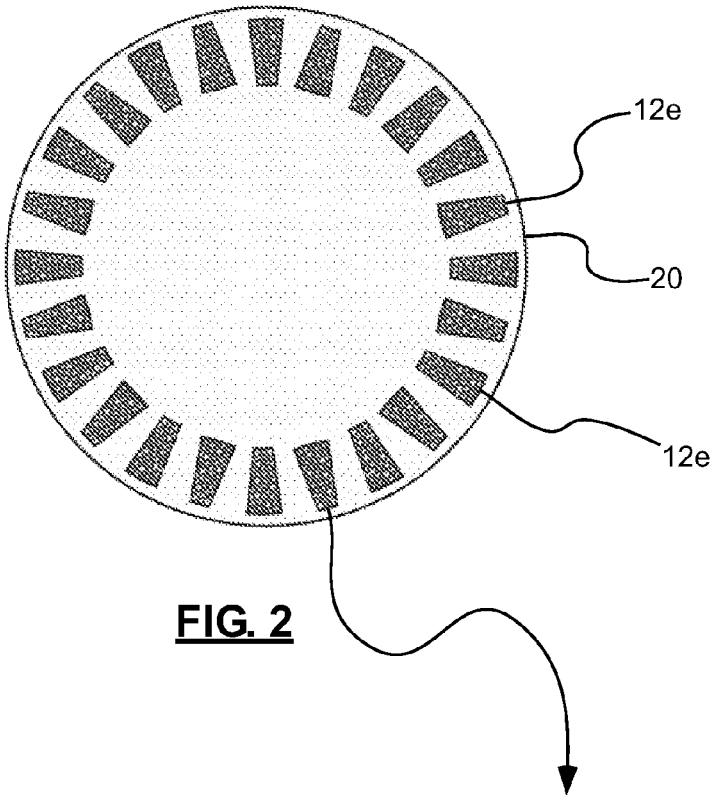
FIG. 2 is a schematic, top plan view of another pad conditioner in accordance with an embodiment of the invention.

While not so required, in one aspect of the invention, the plurality of abrasive segments can each include a substantially matching geometric configuration. In the embodiment illustrated in FIG. 2, each of the plurality of abrasive segments 12*e* presents a substantially wedge-shaped superabrasive profile (that can be truncated, if so desired). The abrasive layer 16*e* can be attached to segment blank 14*e* in a variety of manners, much the same as discussed above.

Figure 2A:
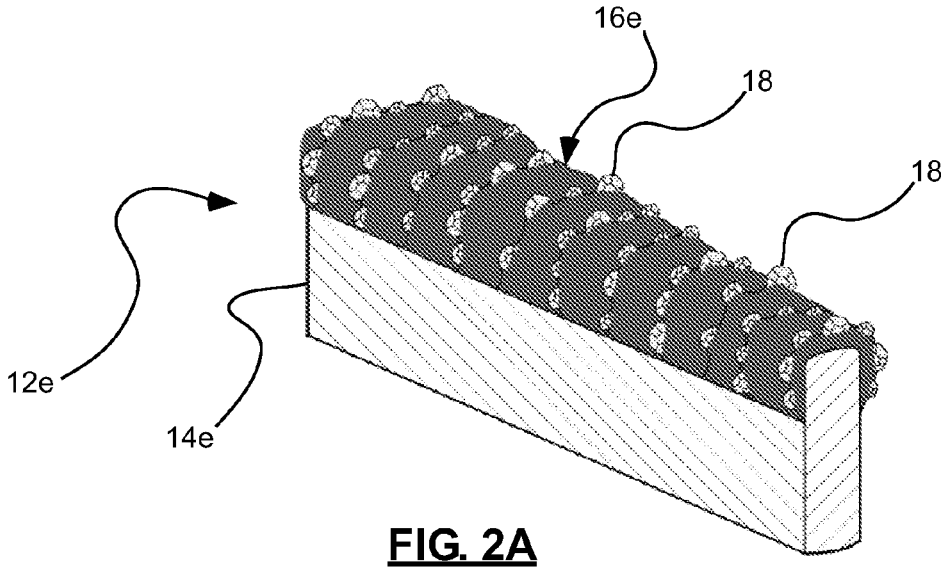
FIG. 2A is an enlarged, perspective schematic view of an abrasive segment of the pad conditioner of FIG. 2.

The plurality of abrasive segments 12*x* can be radially distributed about a face of the pad conditioner substrate 20, and can include a substantially uniform spacing between each segment. Also, a longitudinal axis of each of the plurality of abrasive segments can be aligned along a radius of the pad conditioner substrate. The abrasive segments 12*e* of the embodiment shown in FIGS. 2 and 2A can be arranged across the face of the pad conditioner substrate 20 in alternating or varying alignments: as shown, the tapering portion of the segments can be aligned toward or away from a center of the pad conditioner substrate in alternating stages.

The abrasive segments arranged about the face of the conditioner substrate can each be substantially the same in size, shape, abrasive composition, height relative to one another, etc. In other embodiments, the size, shape, abrasive composition, height relative to one another, etc., can be purposefully varied, to achieve optimal design flexibility for any particular application. Also, each of the afore-mentioned qualities can be varied from segment to another: e.g., alternating segments can include PCD abrasive pieces, chips or slats, with adjacent segments including abrasive particles.

The retention of abrasive segments 12*x* on the pad conditioner substrate 20 can be improved by arranging the abrasive segments such that mechanical stress impinging on any individual abrasive segment is minimized. By reducing the stress impinging on each abrasive segment they can be more readily retained in place on the substrate, particularly for delicate tasks. Minimizing of stress variations between segments can be accomplished by spacing the segments evenly (or consistently) from one another, leveling to a uniform height (relative to the face of the pad conditioner substrate) an uppermost portion of each segment, radially aligning the segments about the face of the pad conditioner substrate, etc. Various other height and spacing techniques can be utilized to obtain a desired affect.

In one embodiment of the invention, the spacing of the abrasive segments can be adjusted to alter the contact pressure of the contact portion (e.g., the portion of the segment that engages and removes material from the CMP pad) of each segment. In general, the farther the segments are spaced from one another, the higher the contact pressure between the segment and the CMP pad. Thus, a higher density of abrasive segments across the face of the pad conditioner substrate can, in some cases, provide a more desirable abrasive interface between the pad conditioner substrate and the CMP pad. In other applications, a lower density of abrasive segments may be beneficial. In either case, the present invention provides a great deal of design flexibility to obtain the optimal abrading profile.

By forming the abrasive segments in individual units having defined geometric shapes, arrangement of the abrasive segments in a very precise manner becomes much easier. As the defined geometric shapes can be replicated fairly precisely from one abrasive segment to another, the positioning of, and accordingly, the stress impinged upon, each abrasive segment can be accomplished fairly consistently across the face of the pad conditioner substrate in question. With prior art abrasive grits, for example, the overall shape and size of each a plurality of grits might change considerably from one grit to another, making precise placement of the grits difficult to accomplish. This problem is adequately addressed by the advantageous features of the present invention.

It has been found that diamond pad conditioners used commercially normally contain about ten thousand diamond grits. Due to the distortion of the substrate, particularly when the disk is manufactured by a high temperature process (e.g. by brazing), and also the distribution of grit sizes and diamond orientations, the cutting tips are located at different heights. When they are pressed against a polishing pad, only about 1% of the protruded diamond can be in engagement with a pad. This can increase the stress on the diamond cutting most deeply into the pad, and the diamond may break and cause catastrophic scratching of the expensive wafers.

By utilizing the present invention, the height difference of between particles can be greatly reduced. In one aspect of the invention, the segments are set on a flat metal (e.g. stainless steel) mold with designed spacing in a retainer ring. Epoxy with hardener fully mixed can be poured into the retainer ring to fill up and cover all segments. The diamond grits on the mold can be shielded by the penetration of the epoxy flow. After curing (with or without heating), the retainer ring and the mold can be removed. The diamond segments are thereby firmly embedded in the epoxy matrix. Due to the leveling of diamond by the flat mold, the tip height variations of the tallest diamond grits are minimized.

The mosaic disk thusly formed can be pressed against the polishing pad with the same fixed load. Resulting tests show that the engagement ratio can be over 50%. In other words, the number of working crystals can be increased many times so that the disk life can be greatly extended. In addition, due to the avoidance of deep cutting, the polishing pad can be used with a much longer life. Also, the dressed grooves can be made much more shallow and less dense. The slurry retention and abrasive utility are both improved. The CMP's cost of consumable (CoC) and cost of ownership (CoO) are both reduced. The wafer polished is more uniform without scratching so the die yield can be higher.

Figure 3A:
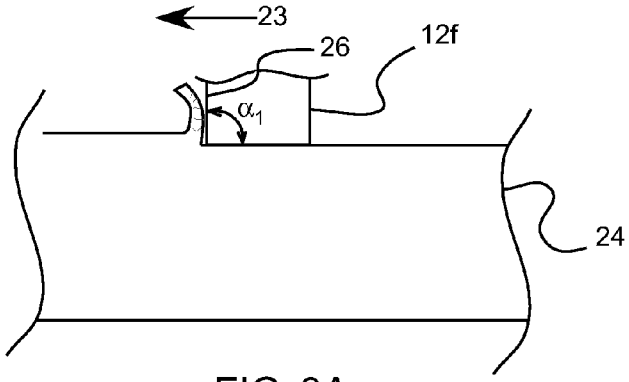
FIG. 3A is a side, schematic view of an abrasive segment having a cutting face shown removing material from a section of a CMP pad.

Turning now to FIGS. 3A-5, a variety of differing embodiments of the invention are illustrated. In FIGS. 3A-3C, an embodiment is shown which aids in addressing issues relating to plastic deformation of a CMP pad (shown by example and in sectioned view at 24). This embodiment reduces the downward force required between the pad conditioner and the CMP pad. As a result, the CMP pad is left with a conditioned surface that is much more smooth and level than that obtained using conventional methods.

Figure 3B:
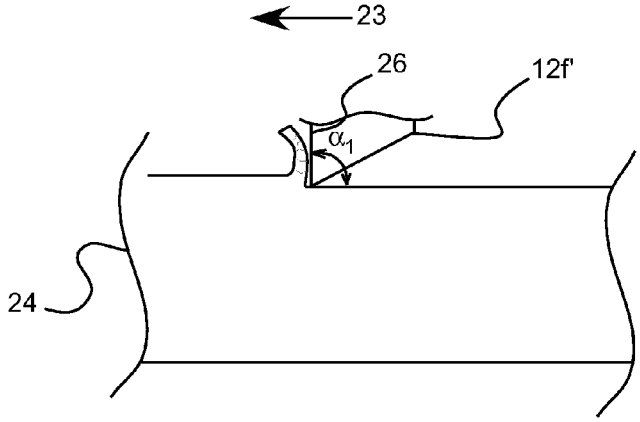
FIG. 3B is a side, schematic view of an abrasive segment having a differently configured cutting face shown removing material from a section of a CMP pad.
Figure 3C:
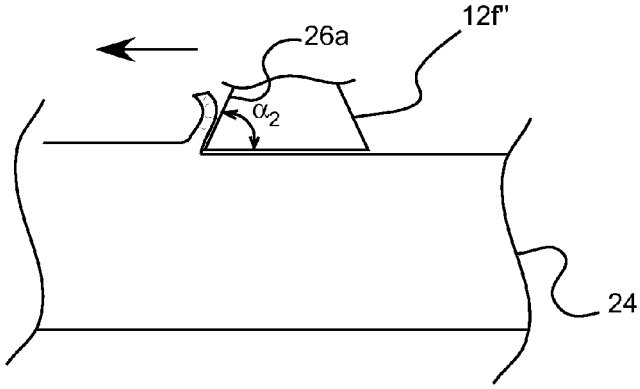
FIG. 3C is a side, schematic view of an abrasive segment having a differently configured cutting face shown removing material from a section of a CMP pad.

The conditioner shown in FIGS. 3A-3C can include abrasive layer 12*f* (only a section of which is shown). The abrasive layer can include a cutting face 26 angled at 90 degrees or less relative to a finished surface to be applied to the CMP pad (e.g., relative to movement of the cutting face away from the finished surface sometimes referred to as a positive cutting angle). The face 26 of the abrasive layer 12*f* can be oriented such that relative movement of the pad conditioner (in the direction indicated at 23 in FIG. 3A) and the CMP pad 24 results in clean removal of material from the CMP pad with the cutting face to thereby condition the CMP pad.

By angling the cutting face 26 at 90 degrees or less, relative to a finished surface to be applied to the pad 24, the dressing process can cleanly shave a layer of pad material from the pad. The resultant surface applied to the pad can be safely used in the CMP process without damaging expensive silicon wafers. The present pad conditioners can be used to shave even a very shallow, thin layer of material from the pad and leave behind a clean, smooth and even finished surface on the pad. This technique can be used to remove thin layers of glaze that can be formed on the surface of the CMP pad.

The cutting face 26 is shown in FIGS. 3A and 3B oriented at an angle $\alpha_1$ of about 90 degrees relative to the finished surface to be applied to the CMP pad. Cutting face 26*a* of FIG. 3C is oriented at angle $\alpha_2$ that is less than 90 degrees relative to the finished surface to be applied to the CMP pad, on the order of about 60 degrees. The cutting faces can be oriented at a variety of angles, and in one embodiment vary from about 45 degrees to about 90 degrees relative to the finished surface of the CMP pad. It has been found that reducing the angle creates an even sharper cutting interface between the cutting element and the pad.

Figure 4A:
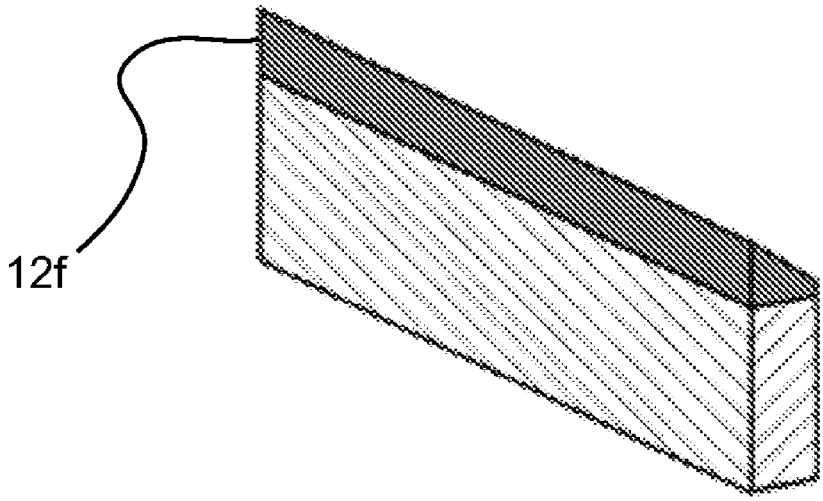
FIG. 4A is a schematic, perspective view of an abrasive segment formed in a blade configuration in accordance with an embodiment of the invention.
Figure 4B:
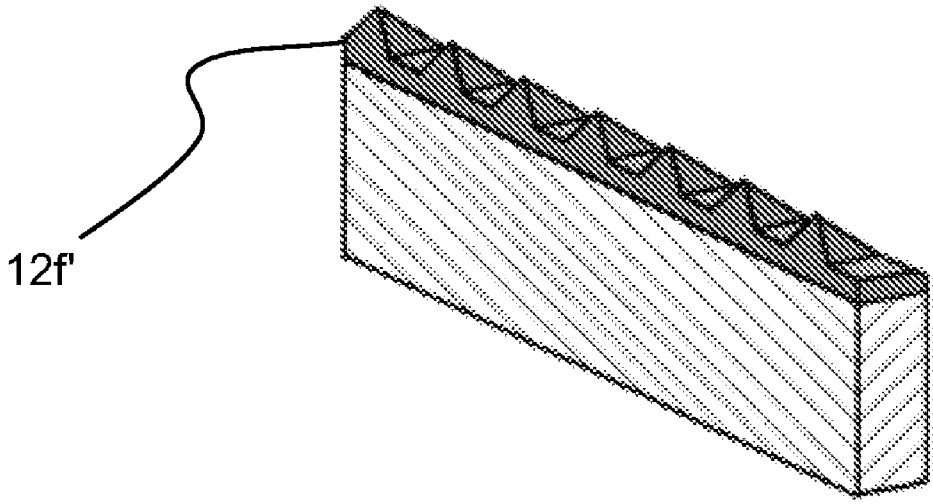
FIG. 4B is a schematic, perspective view of another abrasive segment formed in a blade configuration in accordance with an embodiment of the invention.

The abrasive layers 12*f*, 12*f*' and 12*f*" of FIGS. 3A-3C can be formed (along with their corresponding segment blank, not shown in these figures) as elongate cutting blades. These blades can include a significantly longer length than a width, similar to blade of a conventional kitchen knife. In this aspect of the invention, the blade can be used to cut, scrape or carve a relatively wide swath of material from the PCD pad (24 in FIGS. 3A-3C). As shown by example in FIGS. 4A and 4B, the abrasive layer, shown by example at 12*f* and 12*f*, can include either a substantially continuous cutting edge (as shown in FIG. 4A), or a series of cutting teeth can be formed in the blade (as shown in FIG. 4B). Examples of ways in which such cutting teeth can be formed are detailed in U.S. Provisional Patent Application Ser. No. 60/987,687, filed Nov. 13, 2007, which is hereby incorporated herein by reference.

Those embodiment illustrated in the figures that include angled cutting faces each include a cutting face that is formed having the corresponding angle. In some embodiments, however, it is to be understood that a relatively normal (e.g., 90 degree) cutting face can be utilized, except that the abrasive segment on which the cutting face is formed can be "tilted" when attached to the substrate. In other words, the cutting face is not angled relative to the abrasive segment, rather angling of the abrasive segment results in angling of the cutting face. In this manner, an angled cutting face is provided without requiring that the referenced angle be formed on (or in) the abrasive segment.

Additional and varying abrasive segments for use in the present invention are also contemplated. For example, use is contemplated of the various cutting elements/abrasive segments detailed in U.S. patent application Ser. No. 11/357,713, filed Feb. 17, 2006, which is hereby incorporated herein by reference.

In addition, formation of the abrasive layer on the segment blanks can be accomplished by way of a variety of techniques, including but not limited to vapor deposition techniques similar to those outlined in U.S. patent application Ser. No. 11/512,755, filed Aug. 29, 2006, which is hereby incorporated herein by reference. In addition, the abrasive segments can be formed utilizing ceramic components (as either or both the segment blank and/or the abrasive layer); electroplating techniques, etc.

Figure 5:
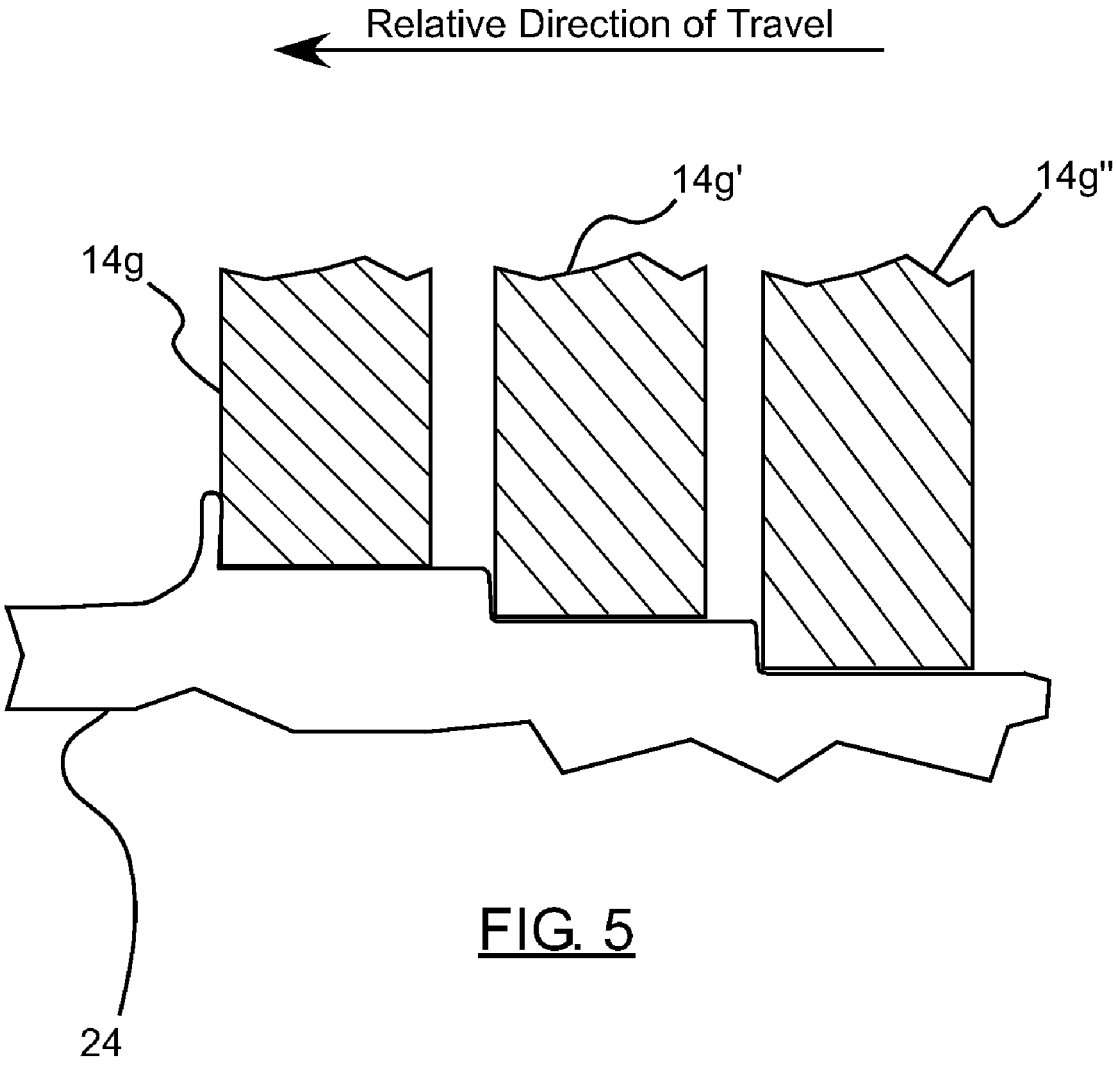
FIG. 5 is a schematic, side view of a portion of a CMP pad dresser having a series of abrasive segments arranged at varying elevations relative to one another.

In the embodiment illustrated in FIG. 5, a series of abrasive layers 14*g*, 14*g*' and 14*g*" is provided, each of which includes a cutting tip oriented at a different elevation. In this aspect of the invention, the leading abrasive segment (of which abrasive layer 14*g* forms a part) is generally at a relatively higher elevation than are trailing abrasive layers 14*g*' and 14*g*", as the trailing layers would not otherwise contact pad material remaining after the leading blade has passed. The abrasive segments having abrasive layers 14*g*, 14*g*' and 14*g*" can be formed in a variety of manners and in a variety of shapes, sizes and configurations, as detailed, for example, in U.S. Provisional Patent Application Ser. 60/988,643, filed Nov. 16, 2007, which is hereby incorporated herein by reference in its entirety. This embodiment can utilize intentionally cascaded cutting elements to achieve a desired abrading affect.

The following examples present various methods for making the pad conditioners of the present invention. Such examples are illustrative only, and no limitation on the present invention is to be thereby realized.

EXAMPLES

Example 1

A pad conditioner was formed by first arranging diamond grit (e.g. 50/60 mesh) on a stainless steel flat mold (also, a slightly convex or contoured mold can be utilized) having a layer of adhesive (e.g. acrylic). A hard rubber material was used to press individual diamond grits into the adhesive while tips of the grits were leveled by the flat mold. A mixture of epoxy and hardener was then poured onto the grit protruding outside the adhesive (a containment ring oriented outside the mold can retain the epoxy). After curing, the mold was then removed and the adhesive was peeled away. The remaining ODD contains diamond grit protruding outside a solidified epoxy substrate. The back of the epoxy can be machined and the disk adhered to a stainless steel (e.g. 316) plate with fastening holes for mounting on a CMP machine.

Example 2

A pad conditioner was formed by radially arranging serrated PCD blades. As in the previous example, the teeth of the PCD blade were leveled with a mold that can be positioned either on the bottom or on the top of the pad conditioner. Epoxy was then cast as in the previous example. In the case that the mold is on the top, the blades are pressed slightly into the slot of a substrate and the slot is sealed by epoxy or silicone.

Example 3

A composite design married the embodiments of Example 1 and Example 2 discussed above. This design leverages the many cutting tips of Example 1 with the cutting efficiency of Example 2. In this Example 3, smaller organic abrasive segments were formed by using a fiber reinforced polymer that is generally harder than epoxy. The organic segments were then radially arranged about a pad conditioner substrate with the blades of Example 2 interspersed therebetween. The cutting tips of the blades were leveled so as to be about 20 microns higher than were the tips of the organic abrasive segments. In this manner, the penetration depth of blade cutting teeth is controlled, while the organic cutting teeth play a secondary role in dressing the pad with the effect of removing glaze and also grooving the pad.

It is to be understood that the above-described arrangements are only illustrative of the application of the principles of the present invention. Numerous modifications and alternative arrangements may be devised by those skilled in the art without departing from the spirit and scope of the present invention and any appended or following claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A CMP pad conditioner, comprising:

a plurality of abrasive segments, each abrasive segment including:

a segment blank; and an abrasive layer including individual abrasive grits attached to the segment blank by a brazing alloy, the abrasive layer including a superhard abrasive material; and a pad conditioner substrate;

each of the plurality of abrasive segments being permanently affixed to the pad conditioner substrate by an organic material layer in an orientation that enables removal of material from a CMP pad by the abrasive layer as the pad conditioner and the CMP pad are moved relative to one another, wherein each of the abrasive layers includes an abrading surface or point, and wherein the abrading surfaces or points are leveled relative to one another such that no abrading surface or point protrudes above another abrading surface or point by more than about 30 microns.

2. The pad conditioner of claim 1, wherein at least some of the plurality of abrasive segments are radially distributed about a face of the pad conditioner substrate.

3. The pad conditioner of claim 1, wherein at least two of the plurality of abrasive segments differ in at least one of: a geometric configuration; an abrasive layer material; and an abrasive profile.

4. The pad conditioner of claim 1, wherein arrangement of the abrasive segments on the face of the pad conditioner substrate uniformly distributes drag forces across substantially each abrasive segment.

5. The pad conditioner of claim 1, wherein a longitudinal axis of each of the plurality of abrasive segments is aligned along a radius of the pad conditioner substrate.

6. The pad conditioner of claim 1, wherein each of the abrasive layers includes an abrading surface or point, and wherein at least one abrading surface or point is oriented at a greater elevation than is an abrading surface or point of an immediately adjacent abrasive layer.

7. The pad conditioner of claim 1, wherein each of the plurality of segment blanks are permanently affixed to the pad conditioner substrate with an organic material layer including one or more of: amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

8. The pad conditioner of claim 1, wherein the abrasive layers comprise PCD blades.

9. The pad conditioner of claim 1, wherein each of the abrasive layers includes a cutting face, and wherein each cutting face is angled at 90 degrees or less relative to a finished surface of the CMP pad.

10. A method of forming a CMP pad conditioner, comprising:

obtaining a plurality of abrasive segments, each abrasive segment including:

a segment blank; and an abrasive layer including individual abrasive grits attached to the segment blank by a brazing alloy, the abrasive layer including a superhard abrasive material;

positioning the at least one abrasive segment on a face of a pad conditioner substrate in an orientation that enables removal of material from a CMP pad by the abrasive layer as the pad conditioner and the CMP pad are moved relative to one another; and permanently affixing the at least one abrasive segment to the pad conditioner substrate with an organic material layer, wherein each of the abrasive layers includes an abrading surface or point, and wherein the abrading surfaces or points are leveled relative to one another such that no abrading surface or point protrudes above another abrading surface or point by more than about 30 microns.

* * * * *